US005097558A

United States Patent [19]

Accorsi et al.

[11] Patent Number: 5,097,558

[45] Date of Patent: Mar. 24, 1992

[54] PRESTRESS RETENTION SYSTEM FOR STRESS LAMINATED TIMBER BRIDGE

[75] Inventors: Michael L. Accorsi, Mansfield Center; Richard P. Long, Storrs; Edward F. Sarisley, Jr., New Britain, all of Conn.

[73] Assignee: The University of Connecticut, Storrs, Conn.

[21] Appl. No.: 538,223

[22] Filed: Jun. 14, 1990

[51] Int. Cl.[5] ..... E01D 19/12; E01D 15/12; E04C 3/10

[52] U.S. Cl. ..... 14/73; 14/2.4; 52/223 L

[58] Field of Search ..... 14/73, 2.4, 17, 1, 21; 52/223 L, 227; 267/204, 171, 162

[56] References Cited

U.S. PATENT DOCUMENTS

| | | | |
|---|---|---|---|
| 3,682,466 | 8/1972 | Huchette et al. | 267/161 |
| 3,856,242 | 12/1974 | Cook | 267/162 |
| 3,873,079 | 3/1975 | Kuus | 267/162 |
| 3,968,010 | 11/1976 | Odobasic | 267/162 |
| 3,980,016 | 9/1976 | Taylor | 267/162 |
| 4,023,242 | 5/1977 | Caro Roqueta | 52/223 |
| 4,262,888 | 4/1981 | Jansen et al. | 267/204 |
| 4,281,726 | 8/1981 | Garrett | 267/162 |
| 4,434,863 | 3/1984 | Garret | 267/162 |

OTHER PUBLICATIONS

Brungraber, R., Gutkowski, R., Kindya, W., McWilliams, R., "Timber Bridges: Part of the Solution for Rural America", Transportation Research Record, No. 1106 (1986), pp. 131–139.

Csagoly, P. F. and Taylor, R. J., "A Structural Wood System for Highway Bridges", Structural Research Report SRR-80-05, Ontario Ministry of Transportation and Communications, 1980.

Taylor, R. J., Batchelor, B., and VanDalen, K., "Prestressed Wood Bridges", Structural Research Report SRR-83-01, Ontario Ministry of Transportation and Communications, 1983.

Taylor, R. J. and Csagoly, P. F., "Transverse Post-Tensioning of Longitudinally Laminated Timber Bridge Decks", Transporation Research Record, No. 665, 1978, pp. 236–244.

Verna, J. R., Graham, J. F., Shannon, J. M., and Sanders, P. H., "Timber Bridges: Benefits and Costs", Journal of Structrual Engineering, ASCE, Jul. 1984, pp. 1563–1571.

*Primary Examiner*—Ramon S. Britts
*Assistant Examiner*—Nancy Connolly
*Attorney, Agent, or Firm*—Fishman, Dionne & Cantor

[57] ABSTRACT

A stress laminated timber bridge deck is disclosed. The deck includes a transversely extending laminate of longitudinally extending timbers and a system for prestressing the laminate. The prestress system includes a pair of longitudinally extending stress distribution channels disposed on opposite sides of the laminate, a number of transversely oriented threaded tension rods, and threaded members, threadably engaged with the tension rods, for tensioning the rods. A disc spring assembly is disposed on each of the tension rods and compressed between the respective stress distribution channels and respective threaded members to reduce the effective stiffness of the deck and thereby reduce prestress losses due to wood creep and temperature variation. A method for measuring prestress in a tensioning rod of the deck of the present invention is disclosed. The method includes the step of comparing the overall height of the disc spring assembly disposed on the rod to a previously determined load-deformation relationship for the disc spring assembly disposed on the rod.

9 Claims, 7 Drawing Sheets

PRESTRESS RETENTION SYSTEM FOR STRESS LAMINATED TIMBER BRIDGE

TECHNICAL FIELD

The present invention relates to bridge structures and more particularly to stress laminated timber bridge structures.

BACKGROUND OF THE INVENTION

The tremendous need for bridge replacements in the nation has caused a renewed interest in timber bridges. The advantages of modern timber bridges have been described in detail, see Brungraber, R., Gutkowski, R., Kindya, W., and McWilliams, R. in "Timber Bridges: Part of the Solution for Rural America," Transportation Research Record, No. 1106, 1986, pp. 131–139 and Verna, J. R., Graham, J. F., Shannon, J. M., and Sanders, P. H. in "Timber Bridges: Benefits and Costs," Journal of Structural Engineering, ASCE, July 1984, pp. 1563–1571. Most importantly, timber bridges are economical and have a long life expectancy. Because timber bridges are easy to construct, a large percentage of the savings is due to reduced construction cost. Unlike steel and concrete, timber is resistant to deicing salts and is generally expected to have a 50 year life span. Furthermore, timber bridges can be built year round, are lightweight which often allows the us of existing substructures, and are often more aesthetic than other low cost alternatives.

Stress-laminated timber bridges are a relatively new type of timber bridge design that have a strong potential for increased use. A stress-laminated bridge deck consists of on-edge longitudinal timbers post-tensioned transversely with high strength steel rods. The rods run across the width of the bridge and are located inside the deck in pre-drilled holes in the laminate. The design was developed about ten years ago in Ontario by Taylor and Csagoly as a means of rehabilitating simple nail laminated timber bridges, see Taylor, R. J., and Csagoly, P. F., "Transverse Post-Tensioning of Longitudinally Laminated Timber Bridge Decks," Transportation Research Record, No. 665, 1978, pp 236–244 and Csagoly, P. F. and Taylor, R. J., "A Structural Wood System for Highway Bridges," Structural Research Report Srr-80-05, Ontario Ministry of Transportation and Communications, 1980.

A series of laboratory tests were conducted by Taylor et al were reported in Taylor, R. J., DeV. Batchelor, B., and Van Dalen, K., "Prestressed Wood Bridges," Structural Research Report SRR-83-01, Ontario Ministry of Transportation and Communications,. 1983 and address some fundamental questions concerning behaving of stressed timber decks. For the deck to perform properly, the prestress level in the deck must cause sufficient friction between the laminates to resist wheel loads without slipping. After initial tensioning, the wood creeps under the applied compression, resulting in loss of stress in the tensioning rods. The prestress force is also effected by temperature changes and moisture content. The effects of wood species, stiffness ratio, tensioning sequence, and relative humidity on prestress loss were examined. As a result of these tests, it was found that the stress ratio, defined as the final prestress level divided by the initial, did not fall below 50%. Consequently, the value of 50% loss of prestress due to wood creep was adopted in the Ontario Highway Bridge Design Code (OHBDC) for design purposes.

Taylor and Csagoly have shown that retention of the initial prestress is improved by decreasing the stiffness ratio of the bridge, see "Transverse Post-Tensioning of Longitudinally Laminated Timber Bridge Decks", supra. The stiffness ratio is defined as the axial stiffness of the prestressing system to that of the wood. This was determined on a laboratory scale under relatively low tensile forces, i.e. about 18 kips, by using large coil springs in series with tensioning rods in a creep testing machine. Use of large coil springs is technically and economically unfeasible with respect to an actual bridge deck, i.e. coil spring assemblies capable of exterting sufficient force to provide a bridge deck having a load carrying capacity of practical significance would be prohibitively unwieldy and expensive.

What is needed in the art is a practical way to address the above discussed difficulties and provide a stress laminated bridge deck that is resistant to prestress losses.

SUMMARY OF THE INVENTION

A stress laminated bridge deck is disclosed. The deck includes a timber laminate, a pair of stress distribution channels on opposite sides of the laminate, a plurality of transversely oriented threaded tension rods and threaded members engaging the rods to prestress the deck. The bridge further includes resilient means, disposed in operative association with the rods, for reducing the effective stiffness of the deck to reduce prestress losses.

A bridge deck is disclosed. The bridge deck includes a transversely extending laminate of longitudinally extending timbers and means for prestressing the laminate. The means for prestressing include a plurality of transversely oriented prestress rods. The bridge deck includes stress distribution means for distributing tensile force from said prestress rods over the laminate and disc spring means, operatively associated with the tension rods, for reducing the effective stiffness of the bridge deck to reduce loss of prestress over time.

A method for reducing prestress losses in a stress laminated timber bridge deck is disclosed. The method includes disposing resilient means on each tension rod between a stress distribution channel and a thread member of the bridge deck and tighting the threaded members to prestress the deck.

A method for measuring prestress in a tension rod of the bridge of the present invention is also disclosed. The method includes determining a relationship between compressive load on a disc spring assembly and deformation of the disc spring assembly, measuring the overall height of the disc spring assembly under compression in a bridge deck of the present invention and comparing the measured height of the compressed disc spring assembly to the load-deformation relationship to obtain the prestress force on the rod associated with the compressed disc spring assembly.

DETAILED DESCRIPTION OF THE INVENTION

Figure 3:
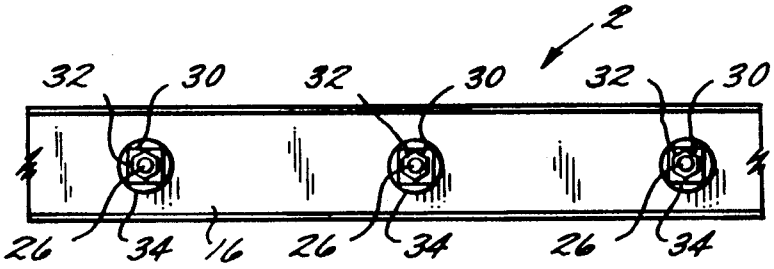
FIG. 3 shows a schematic side view of the bridge deck of FIG. 1.
Figure 1:
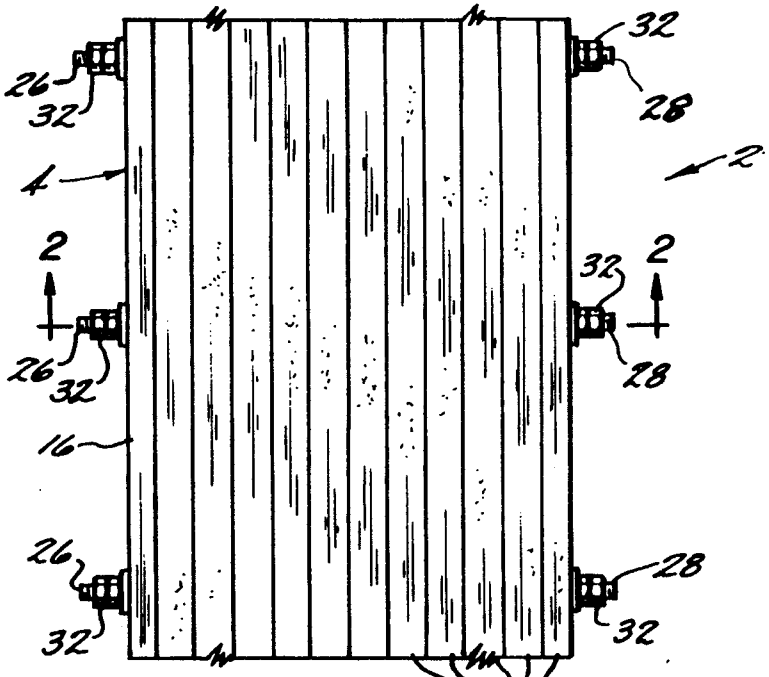
FIG. 1 shows a schematic top view of a portion of a bridge deck of the present invention.
Figure 2:
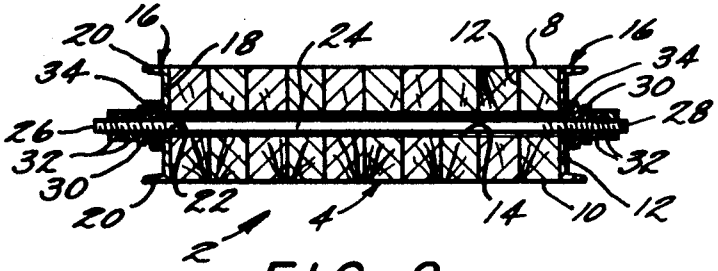
FIG. 2 shows a schematic transverse cross sectional view of the bridge deck shown in FIG. 1 along with 2—2.

A bridge deck 2 according to the present invention is shown in FIGS. 1-3.

The bridge deck 2 includes a transversely extending laminate 4 of longitudinally extending timbers 6. Suitable timbers for use in the bridge of the present invention include, e.g. yellow pine, Douglas fir, red oak and maple. Each of the timbers 6 includes a top edge 8, a bottom edge 10 and a pair of opposed transverse surfaces 12 extending between the top and bottom edges 8, 10. The timbers 6 are oriented parallel to each other and are disposed on edge in side by side contact with each other. The laminate 4 defines a plurality of boreholes 14 (only one of which is shown in FIG. 2) extending transversely across the laminate 4.

A pair of conventional longitudinally extending stress distribution channels 16 are disposed on opposite sides of the laminate 4 to distribute prestress forces uniformly along the length of the bridge deck 2. Each of the channels 16 includes a web 18 and a pair of opposed flanges 20. Each of the channels defines a plurality of longitudinally spaced apart transverse holes 22 (only one of which is shown in each channel 16 of FIG. 2). Each of the holes 22 is transversely aligned with one of the boreholes 14. Suitable stress distribution channels are commerically available from a number of sources, e.g. Berlin Steel of Berlin, Connecticut. Preferably, the channels 16 comprises painted ASTM 588 weathering steel to provide corrosion resistance.

A plurality of conventional prestress rods 24, each extending from a threaded first end 26 through one of the boreholes 14 and corresponding holes 22 to a threaded second end 28 are provided. Preferably, the prestress rods 24 each comprise a high strength steel threadbar. Threadbar that has been found to be particularly well suited to the present invention is commerically available from Dywidag Systems International.

The particular timbers 6, stress distribution channels 16 and prestress rods 24 are each chosen on an application-by-application basis based on conventional design principles.

A compression plate 30 is disposed on each end 26, 28 of each prestress rod 24 and a pair of threaded members 32 are threadably engaged with each end 26, 28 of each rod 24.

A pair of disc spring assemblies 34 each comprising a pair of disc springs are disposed on each end 26, 28 of each prestress rod 24 and secured between one of the stress distribution channels 16 and one of the compression plates 30 to reduce the effective stiffness of the prestress system. The stiffness is defined as discussed above in the background, i.e. as the axial stiffness of the prestress system to that of the wood. The disc spring assemblies 34 fit compactly into the web 18 of the stress distribution channel 16. Disc springs may be stacked in different series and parallel arrangements to obtain assemblies having different overall stiffnesses, flattening loads and traveling distances. A particular disc spring and particular arrangement of disc springs are chosen based on the desired tensile load on the associated tension rod. The disc springs are chosen and arranged so that the disc spring assembly remains deflected, but is not flattened, within the load range of interest. Suitable disc springs are commerically available from a number of sources, e.g. Key Bellevilles, Inc. of Leechburg, Pennsylvania 15656. Alternatively, it is believed that similar benefits may be obtained by substituting a block synthetic elastomeric material for the stack of disc springs.

Figure 4:
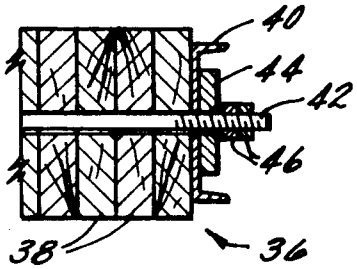
FIG. 4 (PRIOR ART)
FIG. 4 shows a transverse cross sectional view of a portion of a prior art bridge deck.

FIG. 4 shows a portion of a prior art bridge deck 36. The deck 36 includes a plurality of timbers 38, a stress distribution channel 40, a tension rod 42 and an anchor plate 44 for distributing prestress force from the tension rod 42 to the channel 40 threaded fasteners 46.

It should be noted that the disc spring assembly of the present invention, i.e. disc springs 34, and associated compression plate 30, replaces a conventional anchor plate 44 shown in FIG. 4. It should be further noted that, since, for a given application, the cost of a suitable stack of disc springs and compression plate is comparable to that of a prior art anchor plate, the improvement of the present invention may be provided at negligible cost.

The bridge deck 2 is assembled as shown in the drawings and each of the rods 24 is tensioned by tightening the associated threaded members 32 against the resistance of the laminate 4 to prestress the bridge deck 2 to impart sufficient friction between the transverse surfaces 12 of the timbers 6 to allow the bridge deck 2 to resist wheel loads without slippage between adjacent timbers. The required prestress is determined on an application-by-application basis based on conventional design principles. The tensioning process is illustrated in Example 1.

An important feature of the present invention is that the prestress in a tension rod of the deck of the present invention may be quantified by measuring overall height of the disc spring assembly on the rod.

The overall height of a disc spring assembly corresponds to the cumulative outer height of the individual springs of the assembly. For example, in the embodiment described above, the height of a disc spring assembly 34 corresponds to the perpendicular distance between the outer surface of the web 18 of stress distribution channel 16 and the inner surface of compression plate 30 associated with the particular assembly.

The relationship between compressive load on a particular disc spring assembly and deformation of the particular disc spring assembly is determined, either by measurements conducted using the particular disc spring assembly prior to construction of the bridge deck or by reference to a load deformation curve determined by measurement of a disc spring assembly identical to the disc spring assembly of the bridge deck. The overall height of the compressed disc spring assembly of the bridge deck is are measured and compared to the load-deformation relationship to obtain the compressive force applied to the compressed disc spring assembly and thereby obtain the tensile force on the tension rod associated with the compressed disc spring assembly.

It should be noted that calculation of a load-deflection relationship for particular stacked arrangement of disc springs based on nominal properties of the individual disc springs of the stack is not a suitable alternative to experimentally determining the relationship for the particular arrangement of disc springs used as a disc spring assembly on the bridge deck.

Prestress in tension rods of prior art stress laminated bridge decks can be measured only if a costly load cell is permanently installed on the rod during construction of the bridge. It should be further noted that the present invention allows determination of the prestress in each of the tension rods of a stress laminated bridge by simple inspection in the absence of a load cell.

EXAMPLE 1

Figure 5:
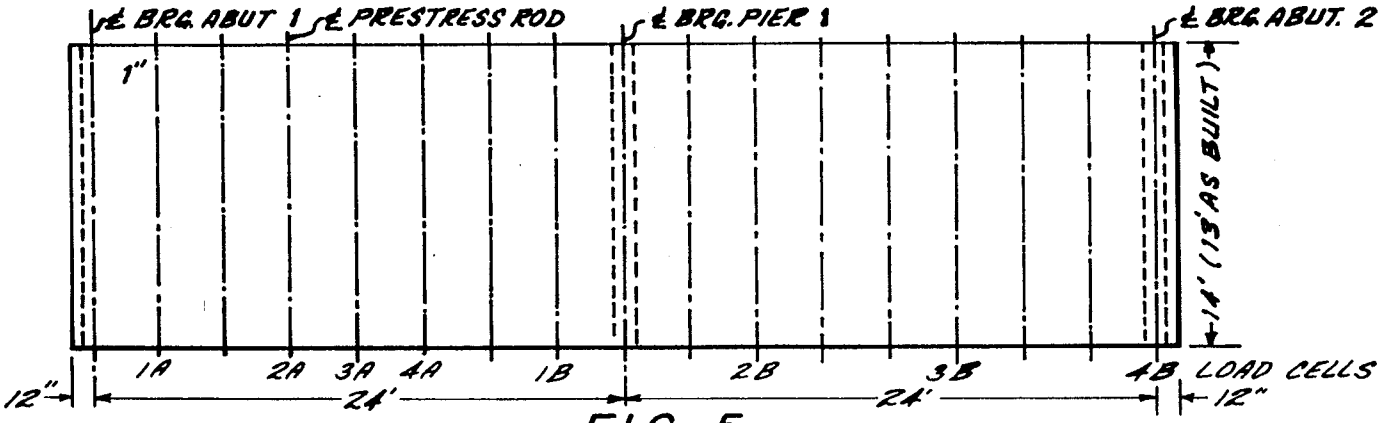
FIG. 5 shows a plan view of a bridge deck.
Figure 6:
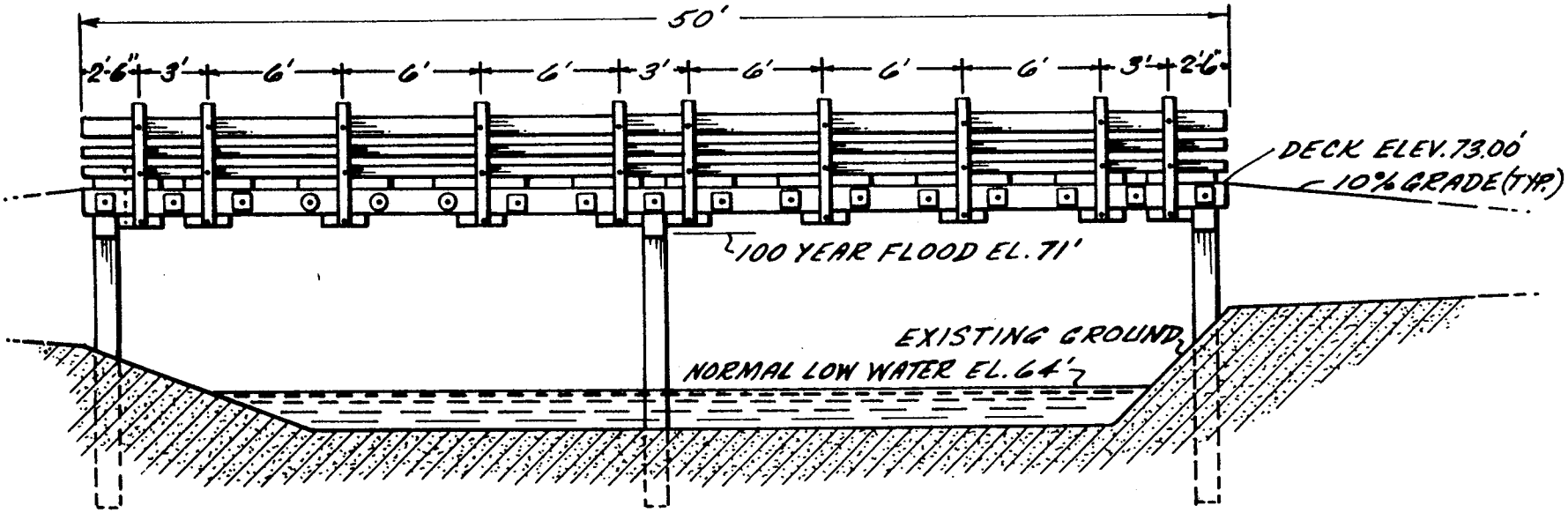
FIG. 6 shows a profile view of the bridge deck of FIG. 4.
Figure 7:
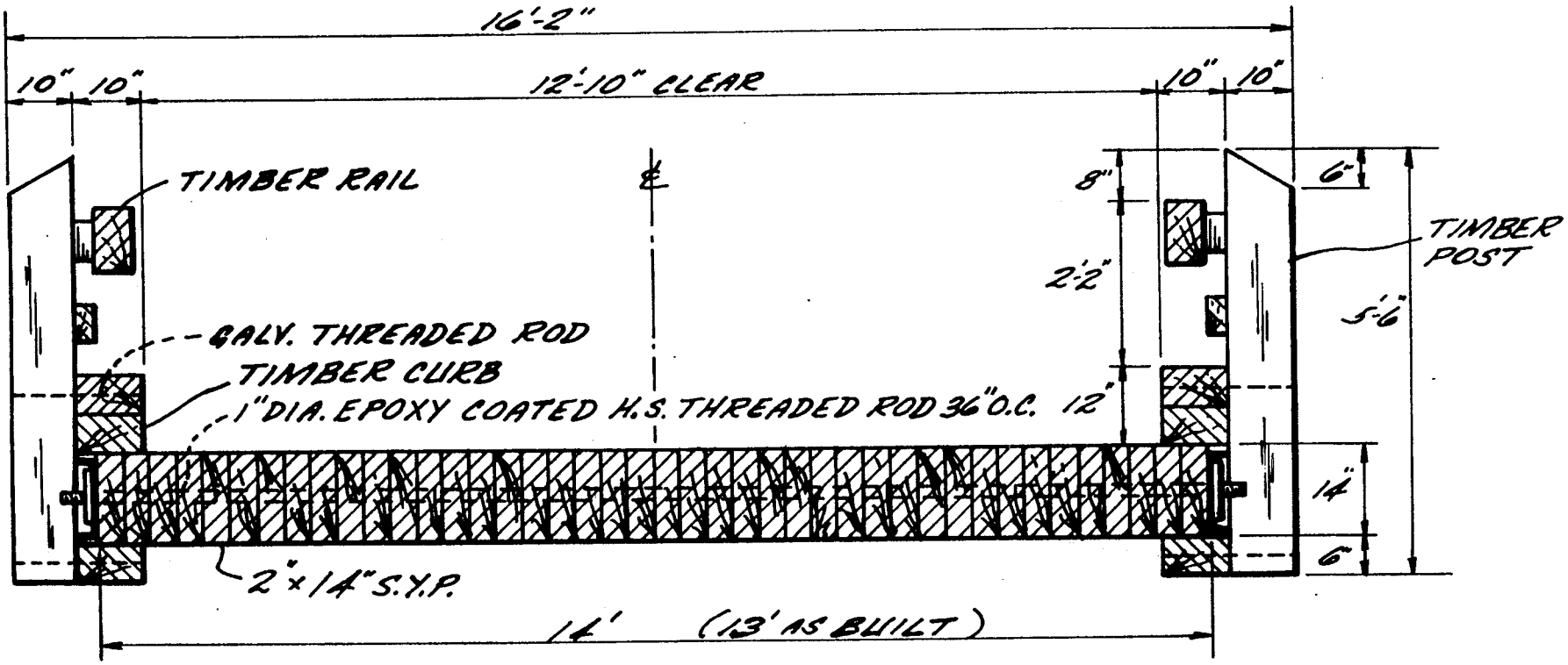
FIG. 7 shows a transverse cross sectional view of the bridge deck of FIG. 5.

A Single-lane, two span continuous bridge with deck of the presentation having dimensions of 50×13 feet (15.25×4.0 m), was built. The deck plan and profile are shown in FIGS. 5 and 6. A transverse cross section view is shown in FIG. 7. The deck was made from 2×14 inch (51×356 mm) timbers of creosote treated southern yellow pine, with lengths ranging from 11 feet (3.35 m) to 20 feet (6.1 m). The prestressing system consisted of 17 rods spaced at 3 feet (0.91 m) intervals, two C12×30 (C310×45) steel distribution channels, and 9×12 inch (229×305 mm) anchor plates.

Epoxy coated hot rolled alloy steel threadbars (Dywidag Systems International) having a continuous rolled-in thread pattern along the entire length and having a nominal diameter of 1.0 inch, a maximum diameter of 1.201 inches and an ultimate stress of 150 ksi were used. Three of the tensioning rods on the bridge were fitted with disc spring assemblies.

Disc springs (Key Bellevilles, Inc.) having an outer diameter of 10.0 inches, an inner diameter of 2.562 inches, a thickness of 0.312 inch, a dish height of 0.349 inch, an overall height of 0.661 inch and a flat load capacity of 1,963 pounds were used.

Figure 9:
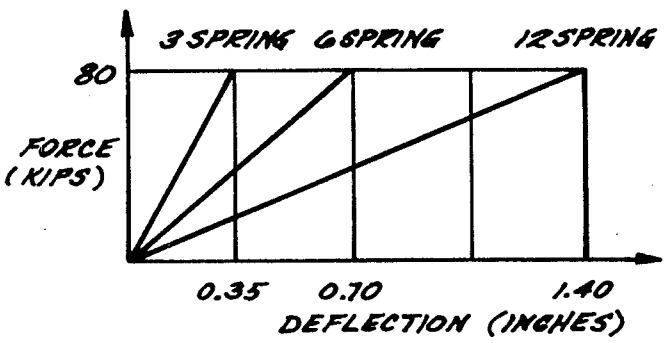
FIG. 9 shows calculated relationships between the tensile force and the deflection of several disc spring assemblies.
Figure 8:
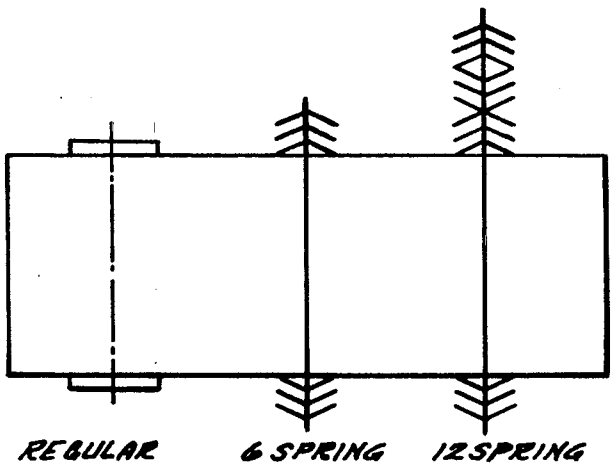
FIG. 8 shows a schematic representation of the prestress assemblies used in the Example 1.

Two of the three rods had a total of 12 springs arranged in 4 series stacks of 3 in parallel, and the third rod had 6 springs arranged in 2 series stacks of 3 in parallel. A schematic of the experimental setups and idealized, i.e. calculated, load-deflection curves for the setups are shown in FIGS. 8 and 9.

Loads cells were installed on eight of the tensioning rods at the locations labelled 1A–4A and 1B–4B in FIG. 5 to measure prestress force.

It was determined in the design of the bridge that a final force of 40 kips (178 kN) per rod was needed for adequate interlaminate friction, i.e. to satisfy the requirements of OHBDC, section 13. According to the OHBDC a 50% loss of prestress should be assumed, which required an initial force of 80 kips (356 kN) per rod.

Figure 10:
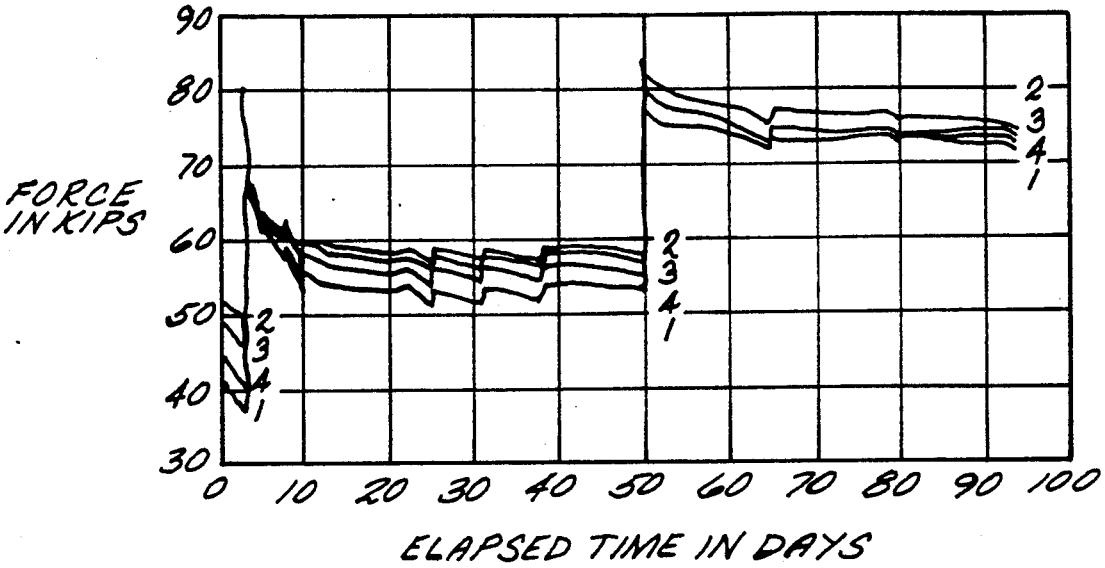
FIG. 10 and 11 show plots of prestress measurements vs time for Example 1.
Figure 11:
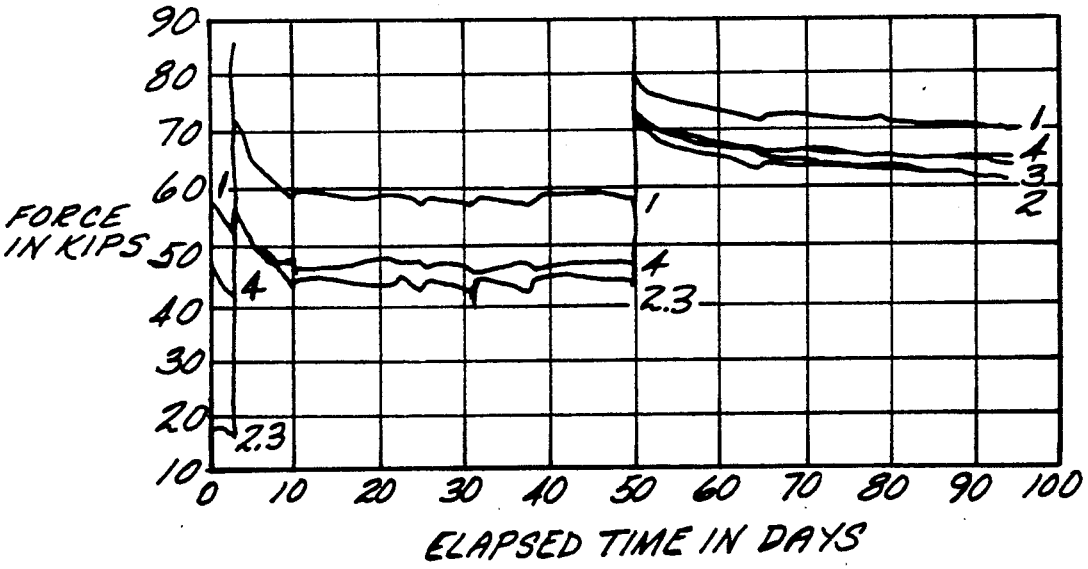

The load cell readings of the prestress force are labeled in FIGS. 10 and 11 as follows:

| | |
|---|---|
| 1A, 1B | regular anchorage, no springs |
| 4A | 6 spring anchorage |
| 2A, 3A | 12 spring anchorage |
| 2B, 3B | regular anchorage w/ low initial prestress |

-continued

| | |
|---|---|
| 4B | regular anchorage at support |

During the first tensioning of the bridge deck, the hydraulic jack failed causing a low level of initial force in two of the instrumented rods. It will be seen that these readings behave differently than the others because of the lower stress level, and therefore are grouped separately. The reading taken at the support location is also different because of the support constraint.

Although the terminology of creep is used, the phenomena is not pure creep since the force in the wood is not constant during time and therefore evaluation of the process becomes more complex.

Figure 12:
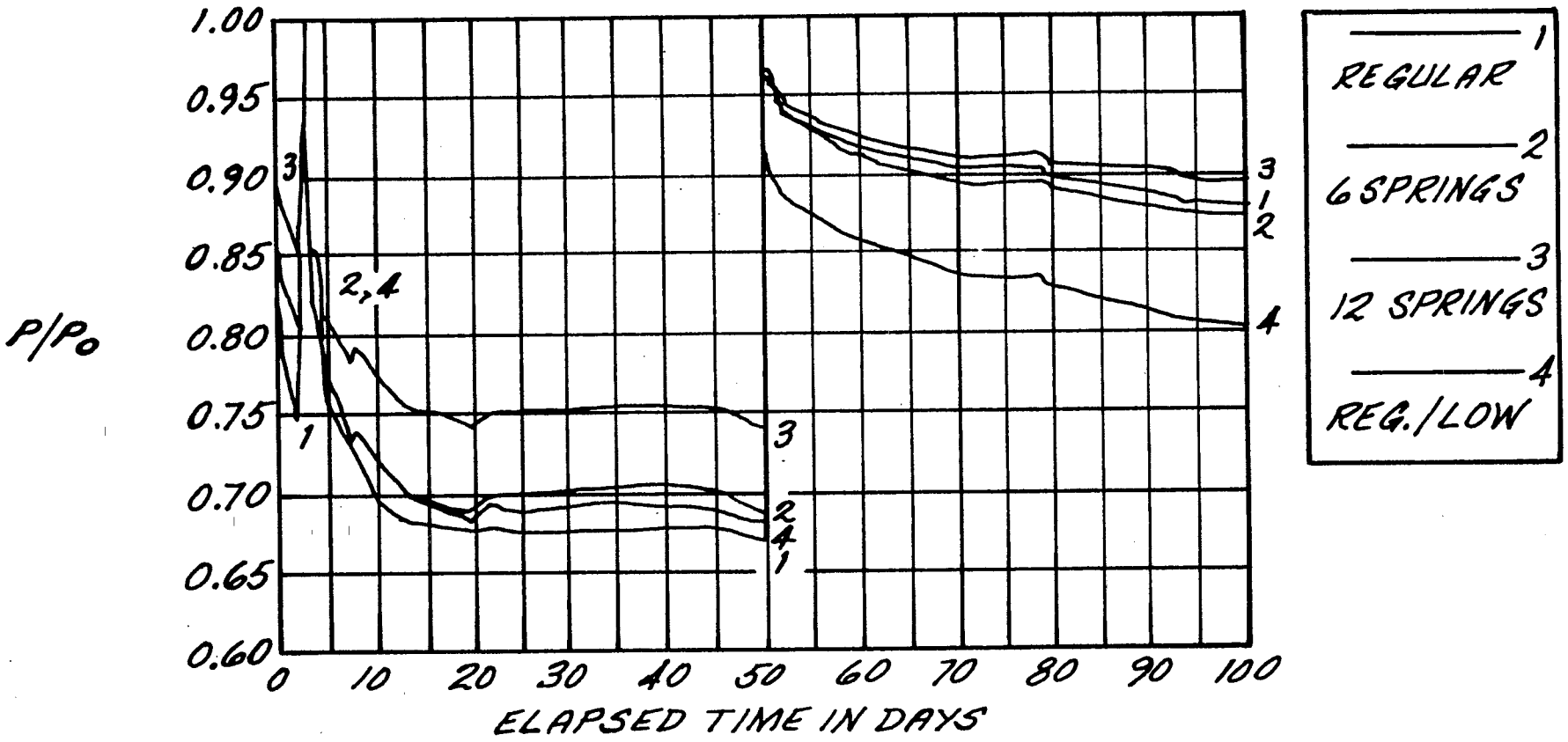
FIG. 12 shows plots of averaged normalized prestress forces vs time.

The bridge was tensioned three times. Fifty days after the last jacking, the prestress readings appear to have leveled off. The average loss of prestress is 15% and all losses are less than 20%. A plot of the prestress readings versus time for the eight instrumented rods is shown in FIGS. 10 and 11. In FIG. 12, these curves have been combined and averaged into the groups described in the previous section, and normalized by the initial prestress force. From FIG. 12 it can be seen that the rods fitted with 12 springs has the highest retention of prestress for all three jacking regions. The rod with 6 springs has the second highest retention in the first two jacking regions, but is lower than the regular anchorage in the third jacking region. In the third jacking region, the prestress force is high enough to flatten the disc spring assembly so that it performs as a regular anchorage. The losses in the third region are in general much less than those of the first two regions, indicating that the creep process is dependent on the stress history of the wood.

EXAMPLE 2

Figure 13:
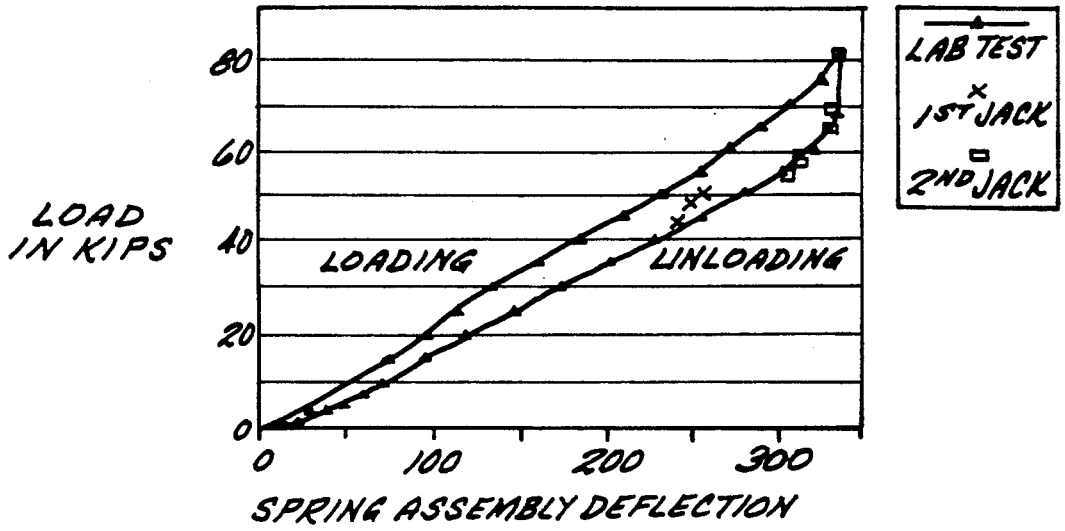
FIG. 13 and 14 show measured points superimposed on plots of calculated load deflection curves for a disc spring assembly.
Figure 14:
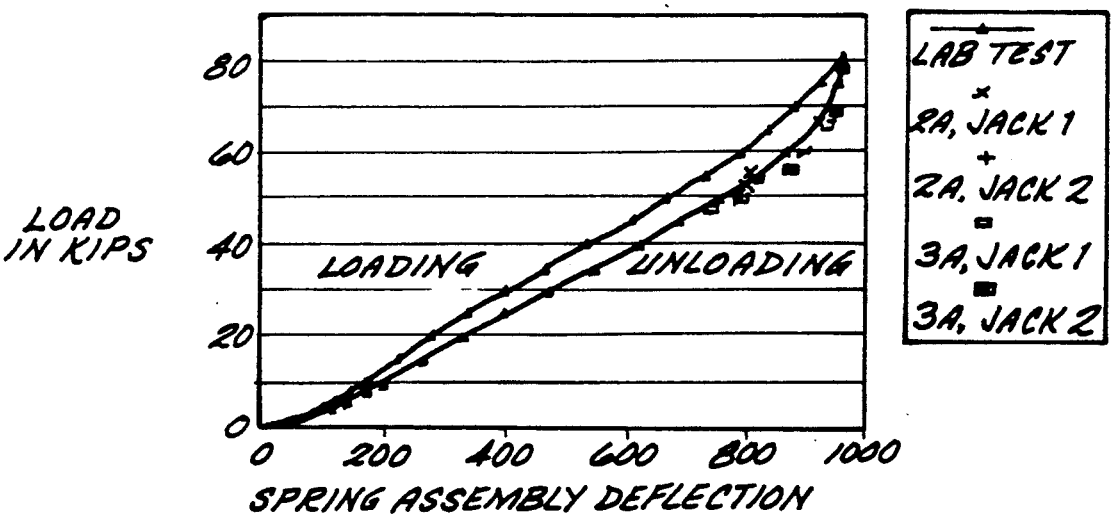

Several disc spring assemblies were tested in the laboratory prior to installation and their load-deformation response was obtained. After installation on the bridge, the height of the spring assemblies were measured and readings of the prestress force from the load cells were taken. These points were plotted on the load-deflection curves for the springs obtained in the laboratory to assess the accuracy of the method. FIGS. 13 and 14 shows the curves obtained in the laboratory and the points measured in the field following the first and second jackings.

The laboratory curves show that the loading and unloading response of the spring assemblies are slightly different due to friction and slipping between the individual springs. It was found, however, that the reproducibility of these curves was very good. The response of the spring assemblies are very steep when there is a transition from loading to unloading or visa versa. The agreement of the field measured values with the laboratory curves is very good indicating that the spring assemblies can be used to measure prestress force fairly accurately.

EXAMPLE 3

Since the coefficient of thermal expansion of wood perpendicular to grain is greater than that of steel, a drop of temperature will cause a decrease in the prestress force and a rise in temperature will increase the prestress force. Although daily temperature fluctuations are small, the change in prestress force due to a seasonal temperature change is significant.

Assuming a maximum seasonal temperature change of 80° F. in the deck, the magnitude of the loss of prestress force in the tension rods of the bridge deck of Example 1 due to temperature variation was estimated as:

| | |
|---|---|
| regular anchorage: | P = 20.7 kips (92.1 kN) |
| 6 spring anchorage: | P = 16.6 kips (73.8 kN) |
| 12 spring anchorage: | P = 13.8 kips (61.4 kN) |

These values are 26, 21 and 17 of the initial prestress force of 80 kips (355.8 kN), respectively, for the regular, 6 spring, and 12 spring anchorages.

The bridge deck of the present invention exhibits reduced loss of prestress due to wood creep and cyclic temperature variation.

The bridge deck of the present invention allows the prestress force in a tensioning rod of the bridge deck to be determined by simple inspection and measurement of the overall height of a disc spring assembly on the tension rod. This simple inspection method eliminates the need for costly load cells and allows periodic evaluation of prestress force of each tension rod in the bridge deck.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A bridge deck, comprising:

a transversely extending laminate of longitudinally extending timbers;

means for prestressing said laminate, said means for prestressing comprising;

a plurality of transversely oriented tension rods; and stress distribution means for distributing tensile force from said rods to said laminate; and disc spring means, operatively associated with at least one of said tension rods, for reducing the effective stiffness of the bridge deck to reduce loss of prestress.

2. The bridge deck of claim 1, wherein, the deck extending transversely from a first side to a second side, wherein, the stress distribution means further comprises a pair of stress distribution channels extending longitudinally along the sides of the laminate in operative association with said means for prestressing.

3. The bridge deck of claim 1, wherein the laminate comprises a plurality of timbers, said timbers each having a top edge, a bottom edge and a pair of opposed transverse surfaces extending between the edges, wherein said timbers are oriented parallel to each other an are disposed on edge in side by side contact with each other.

4. The bridge deck of claim 2, wherein said laminate defines a plurality of longitudinally spaced apart transverse boreholes therethrough and wherein each of the transverse rods extends from a threaded first end through one of the boreholes to a threaded second end and further comprising threaded means, threadably engaging each of said ends, for tensioning said rods.

5. The bridge deck of claim 4, wherein said threaded means comprises a plurality of threaded fasteners and wherein said disc spring means comprises a plurality of disk springs wherein each disk spring is disposed on an end of one of said rods and is compressed between one of said stress distribution channels and one of said threaded fasteners.

6. The bridge deck of claim 5, wherein a plurality of disc spring washers are disposed on each end of each rod and are compressed between one of the stress distribution channels and one of said threaded fasteners.

7. A method for reducing prestress losses in a stress laminated timber bridge deck, said bridge deck including a transversely extending laminate of longitudinally extending timbers, a pair of longitudinally extending stress distribution channels disposed on transversely opposite sides of the laminate, said laminate and channels defining a plurality of longitudinally spaced apart transverse boreholes extending therethrough, a plurality of tension rods, each of said tension rods extending from a first threaded end through one of the boreholes to a second threaded end and a plurality of threaded members, each of said threaded members threadably engaging one of the threaded ends of one of said rods, comprising:

disposing disc spring means on at least one of said rods between one of said stress distribution channels and one of said threaded members; and tightening said one of said threaded members to tension said one of said rods to prestress said bridge deck.

8. The method of claim 7, wherein the resilient means comprises a disc spring.

9. The method of claim 7, wherein the resilient means comprises a plurality of stacked disc springs.

* * * * *

UNITED STATES PATENT AND TRADEMARK OFFICE

CERTIFICATE OF CORRECTION

PATENT NO. : 5,097,558

DATED : March 24, 1992

INVENTOR(S) : Michael L. Accorsi, et al.

It is certified that error appears in the above-identified patent and that said Letters Patent is hereby corrected as shown below:

Col. 1, Row 29: Delete "us" and insert therefor --use--.

Col. 1, Row 50: Delete "were" after "laboratory tests".

Col. 1, Row 46: Delete "Srr" and insert therefor --SRR--.

Col. 2, Row 14: Delete "exterting" and insert therefor --exerting--.

Col. 2, Row 47: Delete "tighting" and insert therefor --tightening--.

Col. 3, Row 47: Delete "commerically" and insert therefor --commercially--.

Col. 3, Row 57: Delete "commerically" and insert therefor --commercially--.

Col. 4, Row 17: Delete "commerically" and insert therefor --commercially--.

Col. 5, Row 1: Delete "are".

Col. 7, Row 12: Delete "26, 21 and 17" and insert therefor --26%, 21% and 17%--.

Col. 7, Row 37: Delete "comprising;" and insert therefor --comprising:--.

UNITED STATES PATENT AND TRADEMARK OFFICE

CERTIFICATE OF CORRECTION

PATENT NO. : 5,097, 558

DATED : March 24, 1992

INVENTOR(S) : Michael L. Accorsi, et al.

It is certified that error appears in the above-identified patent and that said Letters Patent is hereby corrected as shown below:

Col. 8, Row 6: Delete "an" and insert therefor --and--.

Col. 8, Row 18: Delete "disk", both occurrences, and insert therefor --disc--.

Signed and Sealed this

Twenty-second Day of February, 1994

Bruce Lehman

*Attest:*

BRUCE LEHMAN

*Attesting Officer*

*Commissioner of Patents and Trademarks*